United States Patent [19]

Ericsson

[11] Patent Number: 4,551,925

[45] Date of Patent: Nov. 12, 1985

[54] DRIER

[75] Inventor: Sylve J. D. Ericsson, Tumba, Sweden

[73] Assignee: Svecia Silkscreen Maskiner AB, Norsborg, Sweden

[21] Appl. No.: 239,587

[22] Filed: Mar. 2, 1981

[30] Foreign Application Priority Data

Feb. 3, 1981 [SE] Sweden ..... 8100788

[51] Int. Cl.[4] ..... F26B 23/04

[52] U.S. Cl. ..... 34/4; 34/41; 118/642; 34/39

[58] Field of Search ..... 118/642, 643; 34/1, 34/4, 39, 41, 155

[56] References Cited

U.S. PATENT DOCUMENTS

| | | | |
|---|---|---|---|
| 3,894,343 | 7/1975 | Pray et al. | 34/1 |
| 3,900,959 | 8/1975 | Breschi et al. | 34/41 |
| 4,257,172 | 3/1981 | Townsend | 34/68 |

FOREIGN PATENT DOCUMENTS

| | | | |
|---|---|---|---|
| 757250 | 3/1971 | Belgium | 34/4 |
| 2460706 | 7/1976 | Fed. Rep. of Germany | 34/4 |

*Primary Examiner*—Larry I. Schwartz

*Attorney, Agent, or Firm*—Burns, Doane, Swecker & Mathis

[57] ABSTRACT

A drier intended for drying printing ink applied to a material by a printing machine, incorporating a conveyor device consisting of a support for the material as it passes through the drier and at least two organs which emit ultra-violet radiation, UV radiation, for the purpose of drying and/or hardening the printing ink. These two organs which emit UV radiation are located at such a distance from each other that a material which has passed beneath the first organ, where it has been exposed on the one hand to UV radiation for the purpose of hardening the printing ink and on the other hand to the heat emitted by the organ which emits UV radiation, will be able to pass through a section which will cause the temperature of the material to fall before the material passes beneath the second organ.

3 Claims, 2 Drawing Figures

DRIER

TECHNICAL FIELD

The present invention relates to a drier, and above all to a drier of a type which is intended for drying printing ink applied to a material by a printing machine, for example a silk screen printing machine. The drier incorporates a conveyor device consisting of a means of supporting the material as it passes through the drier and at least two organs which emit ultra-violet radiation, UV radiation, for the purpose of drying and/or hardening the printing ink.

The aim of the invention is also to provide details of a drier which is capable not only of drying printing ink which may be hardened by UV radiation, but also of drying solvent-based printing inks.

DESCRIPTION OF THE PRIOR ART

Various types of driers attached to printing machines have already been disclosed for drying, the printing ink which is applied to a material by the printing machine.

The drying process and the drying methods which may be involved are determined by the chemical composition of the ink and of the printed material.

Thus the possibility has already been disclosed of producing catalytic hardening or polymerisation of the printing ink when the ink has characteristics such that it is able to harden with the aid of organs which emit ultra-violet radiation.

The possibility has also been disclosed in the case of solvent-based printing inks of permitting the drying process to take place by evaporation or vaporization, i.e. by physical drying.

It has also been disclosed previously that physical drying, which takes place by the evaporation or varporization of solvents which are present in the printing ink, may be made to proceed more rapidly by increasing the quantity of air which is blown and the supply of heat.

Also previously disclosed are printing inks of such a kind that hardening of the printing ink will take place with the aid of ultra-violet radiation by the process known as radiation hardening, in which the radiation activates a catalyst in the printing ink, thereby causing polymerisation (a linking together of molecules) of the layer of ink.

The most common type of screen printing inks dry by evaporation or by hardening or by a combination of both.

Special problems are encountered with the drier used with a silk screen printing machine, since the layer of printing ink which is applied may often be quite thick.

SUMMARY OF THE PRESENT INVENTION

TECHNICAL PROBLEM

Several different kinds of driers have in fact already been disclosed which make use of organs which emit ultra-violet radiation. The ultra-violet radiation hardens the printing ink which is usually applied to glass, sheet metal and printed circuit boards. A drier which makes use of UV radiation is very simple, since one or more organs which emit UV radiation are installed above the conveyor, usually in the form of a gas discharge tube which emits very intense UV radiation and which will cause the printing ink to harden in a matter of seconds.

However, driers which make use of organs which emit ultra-violet radiation do suffer from the disadvantage that, although the actual hardening process as such may take place at ambient temperature, the mercury lamps which are currently available are designed in such a way that they will emit UV radiation only after having reached a high operating temperature. It is not unusual for the lamp to be required to reach a temperature of between 600° and 700° C. It will be appreciated that a considerable amount of heat output will thus be lost and is not required for the purpose of hardening the printing ink.

One additional practical consequence is that a drier which uses UV radiation must, as a rule, have two or more lamps positioned adjacent to each other in order to produce radiation of sufficient intensity to thoroughly harden the relatively thick layers of ink.

It will also be appreciated that the heat emission referred to above is of only marginal significance to the hardening of printing ink on glass or sheet metal and that the thermal radiation speeds up the hardening process to a certain extent, but that where hardenable printing inks are applied to temperature-sensitive materials such as paper and plastic the result will usually be contraction and in certain cases deformation of the material.

The aim of the present invention is to provide details of a drier of such a kind that when printing ink is applied to a material which is temperature-sensitive hardening may still take place in the drier without major contraction of the material occurring.

It has also been disclosed previously that a drier which is specially designed to harden and dry printing ink with the help of UV radiation may only be used for hardening that particular ink, and that this limitation is not always desirable in mixed production where solvent-based printing inks may also be used.

It is therefore particularly desirable to design a drier of such a nature that it is not only capable of hardening printing ink by means of UV radiation, but is also suitable for drying solvent-based printing inks.

SOLUTION

The present invention describes a drier, intended above all for drying printing ink applied to a material by a printing machine, especially a silk screen printing machine. The drier incorporates a conveyor device consisting of a means of supporting the material as it passes through the drier and at least two organs which emit UV radiation for the purpose of drying and/or hardening the printing ink.

What may be regarded as being characteristic of the present drier is the fact that two organs which emit UV radiation are located at such a distance from each other that the material which passes beneath the first organ, where it has been exposed on the one hand to UV radiation for the purpose of hardening the printing ink and on the other hand to the heat emitted by the organ which emits UV radiation, will be able to pass through a section which will cause the temperature of the material to fall before the material is allowed to pass beneath the second organ.

This arrangement thus enables the section between the organs to be used for treating the material with air, preferably chilled air, thereby eliminating the disadvantage described previously.

Where a number of organs which emit UV radiation, being more than two in number, are used in the drier, it is recommended that the space between each organ and the next should be used for treating the material with chilled air.

Nevertheless, there is nothing to prevent a group or organs which emit UV radiation, usually two in number, from being positioned adjacent to each other, and arranging the air treatment section between adjacent groups.

The present invention also describes a possibility of using the drier for solvent-based printing inks, when the organs which emit ultra-violet radiation may be disconnected and ordinary air or heated air used for drying the solvent-based printing ink in the section between the organs.

It may also be appropriate for the organs which emit UV radiation to be left connected during the drying of solvent-based printing inks, thus enabling use to be made of the waste heat produced by the organ which emits UV radiation.

It may also be appropriate for the power source to which the organs which emit UV radiation are connected to be disconnected; with the power source being used for heating the air used for drying the solvent-based printing inks.

BRIEF DESCRIPTION OF THE DRAWINGS

The attached drawing illustrates the significant characteristics of a proposed embodiment of the present invention, in which.

DETAILED DESCRIPTION OF THE PREFERRED EMBODIMENT

The present invention relates to a drier, said drier being intended above all for drying printing ink applied to a material by a printing machine.

Figure 1:
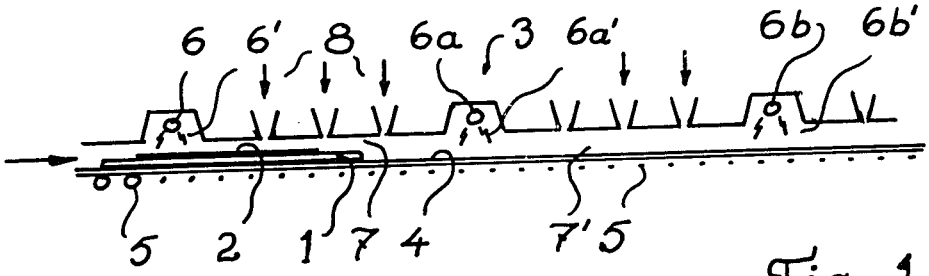
FIG. 1 is a side view sectional view of part of a drier from which the principle of the present invention may be appreciated.

It is evident that the drier requires a power supply, air fans, heating devices and similar, although these components are not shown in FIG. 1 since they do not represent an essential part of the present invention. Nor does FIG. 1 show a printing machine, preferably a silk screen printing machine designed to apply printing ink to a material. The material shown in FIG. 1 has been identified with the reference 1 and the printing ink applied by the printing machine has been identified with the reference 2. A drier 3 incorporates a conveyor device 4 in the form of a belt resting on a number of rollers 5. The conveyor belt 4 together with the rollers 5 thus constitute a means of supporting the material 1 as it passes through the drier. This embodiment also contains at least two, and in the case of the preferred embodiment three organs 6, **6*a* and 6*b* which emit UV radiation for the purpose of drying and/or hardening the printing ink, although their number is not critical to the function of the invention. In accordance with the present invention the two organs 6, 6*a* which emit UV radiation are located at such a distance from each other that a material 1 which passes beneath the first organ 6, where it is exposed on the one hand to UV radiation 6' for the purpose of hardening the printing ink 2 and on the other hand to the heat emitted by the organ 6 which emits UV radiation, will be able to pass through a section 7 which will cause the temperature of the material 1 and of the layer of ink 2 which has been applied to it to fall before the material moves over to the second organ 6*a*, where it is exposed to UV radiation 6*a'* for the purpose of further hardening of the printing ink on the one hand, and on the other hand is exposed to the heat emitted by the organ 6*a*** which emits UV radiation.

The section 7 between the organs 6 and **6*a* is designed in such a way as to enable the material 1 to be treated with air, preferably chilled air. It is also recommended that the air be allowed to pass through nozzles 8**.

Although the preferred embodiment shows single organs 6, **6*a* and 6*b* which emit UV radiation, there is nothing to prevent these organs from being replaced by a group, usually two in number, of organs which emit UV radiation in such a way that a section 7** will then lie between adjacent groups.

Whether a group shall contain one or more organs is determined by the speed at which the material 1 passes through the drier, as well as by the nature of the material, the thickness of the printing ink and the facilities for cooling provided in the section 7.

Figure 2:
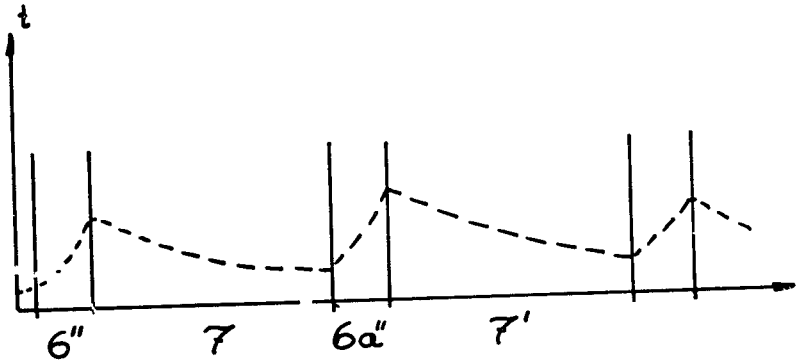
FIG. 2 is a graph of the temperature variations within the material as it passes through the drier.

FIG. 2 shows the temperature curve "T" for the material 1 as it passes through the drier illustrated in FIG. 1. There is a rise in temperature in the section 6'' due to the heat, infra-red heat, produced by the organ which emits UV radiation, but as soon as the material 1 passes into the section 7, the material is acted upon by the air flowing through the nozzles 8, causing the material to cool, and as soon as the material enters the section **6*a''* there is a corresponding rise in temperature. The section 7'** produces a further fall in temperature, and so on.

Although FIG. 2 shows the temperatures at the end of sections 6'' and **6*a''*** to be essentially identical, it should nevertheless be borne in mind that a certain rise in temperature is permissible.

The present invention also relates to a drier in which the material 1 to which a solvent-based printing ink 2 has been applied is subjected to drying in said drier, which may be done either by disconnecting the organs 6, **6*a*, 6*b* which emit UV radiation and exposing the printing ink 2 to treatment with air passing through the nozzles 8 in the section 7**.

Or, in view of the high heat loss from the organs 6, **6*a* and 6*b*, it may be appropriate to leave said organs connected so that the infra-red radiation emitted by the organs will remove the solvent from the printing ink 2**.

In many cases, however, it may be found more advantageous to disconnect said organs 6, **6*a*, 6*b* and to connect their electrical power supply instead to a heating element not shown in the Figure for the purpose of heating the air passing through the nozzles 8**.

It may be appreciated in each case that a drier in accordance with the present invention which has been designed principally to provide effective hardening of a printing ink by organs which emit UV radiation may also be used for drying solvent-based printing inks by a process of evaporation.

The invention is not, of couse, restricted to the typical embodiment described above, but may undergo modifications within the scope of the following patent claims.

A drier in accordance with the present invention will be found to be particularly advantageous if the printing ink which has been applied to the material is in the form of a mixture of printing inks which on the one hand require the use of organs which emit UV radiation in order for them to harden, and which on the other hand require the use of vaporization and treatment with air in order to dry the solvent-based printing inks.

The distance between the organs 6, 6*a* may, of course, be varied in accordance with the speed of the conveyor, the thickness of the ink, and the intensity of the organ which emits UV radiation, etc., although in practice this distance should be between 0.5 and 1.5 meters.

I claim:

1. A drier, intended principally for drying printing ink applied to a material by a printing machine, the drier comprising a conveyor device including means for supporting the material as the material passes through the drier, more than two, separately arranged organs which emit ultra-violet radiation for drying and/or hardening the printing ink, the organs which emit UV radiation being spaced a distance of 0.5 to 1.5 meters from each other such that a material which passes beneath a first organ, where the material has been exposed to both UV radiation for hardening the printing ink and to the heat emitted by the organ which emits UV radiation, passes through a section of the drier between the organs, and a plurality of nozzles arranged above said section for directing cooling air toward the material such that the temperature of the material falls substantially before the material passes beneath a second organ, the cooling air being chilled air.

2. The drier in accordance with claim 1, wherein the organs are arranged in groups of at least two in number, said organs within each group being located adjacent to each other, and each group being spaced by the distance of 0.5 to 1.5 meters from adjacent groups.

3. A drier, intended principally for drying material to which a solvent-based printing ink has been applied and which has been discharged from a printing machine, the drier comprising a conveyor device including means for supporting the material as the material passes through the drier, at least two organs which emit ultra-violet radiation for drying the printing ink, the two organs which emit UV radiation being spaced a distance of 0.5 to 1.5 meters from each other, thereby defining a section of the drier within which the material is subjected to a treatment with air, said treatment with air using hot air for further drying the solvent-based printing ink, and means for disconnecting the organs which emit UV radiation for drying the printing ink such that air which has been heated is used for drying the solvent-based printing ink.

* * * * *